US011834223B2

(12) United States Patent
Gabel et al.

(10) Patent No.: US 11,834,223 B2
(45) Date of Patent: Dec. 5, 2023

(54) PALLET ASSEMBLY

(71) Applicant: PALIoT Solutions, Inc., Plymouth, MI (US)

(72) Inventors: Jacob Gabel, Lapeer, MI (US); Herman J. Novak, Maryville, TN (US)

(73) Assignee: PALIoT Solutions, Inc., Plymouth, MI (US)

( * ) Notice: Subject to any disclaimer, the term of this patent is extended or adjusted under 35 U.S.C. 154(b) by 0 days.

(21) Appl. No.: 17/971,208

(22) Filed: Oct. 21, 2022

(65) Prior Publication Data

US 2023/0129319 A1 Apr. 27, 2023

Related U.S. Application Data

(63) Continuation of application No. 63/270,702, filed on Oct. 22, 2021.

(51) Int. Cl.
*B65D 19/00* (2006.01)

(52) U.S. Cl.
CPC ..... *B65D 19/0028* (2013.01); *B65D 2203/10* (2013.01); *B65D 2519/00029* (2013.01); *B65D 2519/00064* (2013.01); *B65D 2519/0086* (2013.01); *B65D 2519/00273* (2013.01); *B65D 2519/00288* (2013.01); *B65D 2519/00323* (2013.01); *B65D 2519/00338* (2013.01)

(58) Field of Classification Search
CPC .... B65D 19/0028; B65D 2519/000029; B65D 2519/00064; B65D 2519/00273; B65D 2519/00288; B65D 2519/00323; B65D 2519/00338; B65D 2519/0086; B65D 2203/10
USPC ..... 108/51.11, 57.25, 51.3
See application file for complete search history.

(56) References Cited

U.S. PATENT DOCUMENTS 4,790,249 A * 12/1988 Webb ..... B65D 19/0012 428/116
5,042,396 A * 8/1991 Shuert ..... B65D 19/0012 248/618
5,129,329 A * 7/1992 Clasen ..... B65D 19/0012 108/52.1

(Continued)

FOREIGN PATENT DOCUMENTS

WO WO-2006094121 A2 * 9/2006 ..... B65D 19/0012

*Primary Examiner* — Jose V Chen
(74) *Attorney, Agent, or Firm* — Miller Johnson

(57) ABSTRACT

A pallet assembly includes a top plate and a runner having four side surfaces. The pallet assembly includes a pallet integrated module mounted to the pallet assembly and configured to collect journey data for transmission to a cloud. The pallet assembly includes a load-force plate disposed between the top plate and the runner. The load-force plate is configured to increase load bearing capacity of the top plate while adding strength to the pallet assembly. An antenna for the pallet integrated module is integrated with the load-force plate. The pallet assembly includes multiple load blocks disposed between the load-force plate and the runner. The load blocks are symmetrically positioned such that a forklift can enter from any of the four side surfaces of the runner. The runner is disposed under the load blocks. The pallet assembly includes a coating material that protects shipment of products that require sanitary conditions.

19 Claims, 14 Drawing Sheets

(56) References Cited

U.S. PATENT DOCUMENTS 5,213,050 A * 5/1993 Juvik-Woods ..... B65D 65/44 108/56.1
5,687,653 A * 11/1997 Bumgarner ..... B65D 19/0091 108/57.32
6,807,910 B2 * 10/2004 Apps ..... B65D 19/38 108/57.25
7,712,421 B2 * 5/2010 Hartel ..... B65D 19/0073 108/51.11
8,077,040 B2 * 12/2011 Muirhead ..... G06Q 50/28 340/568.5
8,850,993 B2 * 10/2014 Storteboom ..... B65D 19/0002 108/51.11
9,776,762 B2 * 10/2017 De Beer ..... B65D 19/0091
11,332,276 B2 * 5/2022 Liang ..... B65D 19/0073
2003/0079657 A1 * 5/2003 Preisler ..... B65D 19/0012 108/51.3
2004/0217867 A1 * 11/2004 Bridgelall ..... G06K 19/07796 340/572.8
2006/0201402 A1 * 9/2006 Moore, Jr. ..... B65D 19/0038 108/57.25
2006/0254474 A1 * 11/2006 Roth ..... B65D 19/0095 108/51.11
2008/0103944 A1 * 5/2008 Hagemann ..... G06Q 10/0833 108/51.11
2008/0115699 A1 * 5/2008 Miller ..... B65D 19/0095 108/56.1
2008/0210140 A1 * 9/2008 Valentinsson ..... B65D 19/0014 108/51.11
2009/0000527 A1 * 1/2009 Ficker ..... B65D 19/0016 108/57.25
2010/0182150 A1 * 7/2010 Edelstain ..... G06K 19/07758 29/428
2011/0120353 A1 * 5/2011 Jensen ..... B65D 19/0073 108/57.25
2011/0303128 A1 * 12/2011 Linares ..... B65D 19/0012 108/51.11
2012/0037050 A1 * 2/2012 Nevo ..... B65D 19/0038 108/51.11
2012/0079966 A1 * 4/2012 Huang ..... B32B 27/36 156/267
2012/0160137 A1 * 6/2012 Linares ..... B65D 19/0026 108/57.32
2012/0260832 A1 * 10/2012 Linares ..... B65D 19/0095 108/57.17
2013/0014676 A1 * 1/2013 Imbrecht ..... B32B 27/065 108/57.25
2013/0160680 A1 * 6/2013 Ten Bok ..... B29C 69/02 264/41
2015/0025190 A1 * 1/2015 Grinsteinner ..... C08L 23/10 524/436
2015/0210425 A1 * 7/2015 Miller ..... B65D 19/0095 108/57.17
2015/0274359 A1 * 10/2015 Linares ..... B65D 19/0004 108/53.1
2016/0114936 A1 * 4/2016 Muirhead ..... B65D 19/0012 108/57.25
2016/0311572 A1 * 10/2016 Wilhelm ..... B65D 19/0026
2017/0021963 A1 * 1/2017 Apps ..... B65D 19/0069
2017/0275493 A1 * 9/2017 Linares ..... C09D 175/04
2018/0215505 A1 * 8/2018 Hawley ..... B65D 19/0095
2018/0215509 A1 * 8/2018 Shoop ..... B65D 25/34
2019/0135485 A1 * 5/2019 Apps ..... B65D 19/0038
2019/0168912 A1 * 6/2019 de Bokx ..... B65D 19/0073
2019/0235092 A1 * 8/2019 Bastian, II ..... G01G 19/52
2021/0009310 A1 * 1/2021 Moeller ..... G06K 19/07786
2021/0055152 A1 * 2/2021 Ekkel ..... G01G 19/52

* cited by examiner

TOP PLATE

LOAD-FORCE PLATE
CROSS CONFIGURATION

LOAD-FORCE PLATE
X CONFIGURATION

RUNNER

LOAD BLOCK

PALLET INTEGRATED MODULE

SIGNAL EXTENDER

ANTENNA CONTACT TRACKING SENSOR

ANTENNA REPEATER
NO ELECTRICAL CONTACT TO PIM (TRACKING SENSOR)

Electrical Contact Between Tracking Sensor and Antenna.

Electrical Contact Between Tracking Sensor and Antenna.

PALLET ASSEMBLY

CROSS-REFERENCE TO RELATED APPLICATIONS

This Application claims the benefit of U.S. Provisional Application No. 63/270,702, entitled "A New Generation in Pallet Technology" (Gabel and Novak), filed on Oct. 22, 2021.

FIELD OF USE

This invention is in the general field of load-bearing structures and, more particularly, to pallets used for transporting and storing goods.

BACKGROUND OF THE INVENTION

The pallet provides support for cargo particularly during shipment and storage.

The pallet is one of the most ubiquitous elements of the transport and logistic network that serves the global supply chain.

A pallet is a flat transport structure used to support goods in a stable manner. The pallet provides a platform for items to be loaded securely onto and enables forklifts or other utility vehicles to insert arms underneath and into the platform for lifting and manipulation.

Most pallets shipped across national borders must be made of materials that are incapable of carrying invasive species of insects and plant diseases or must be heat/chemically treated prior to international movements.

Further, the surface of a wooden pallet is unsanitary for the transport of food since the pallet potentially can harbor insects, mold, and bacteria. Thus, a wooden pallet is generally ill-suited for the shipment of foodstuffs and other products requiring sanitary conditions. Consequently, such pallet surface must be free of insects, mold, plant diseases, and bacteria clean prior to each use.

In addition, untreated wooden pallets used to transport food can harbor pathogens such as *E. coli* and *Listeria*.

Some of the more relevant prior art includes:

U.S. Pat. No. 10,549,885, entitled "Pallet and Logistic System" (de Bokx and Ekkel) was filed on Jan. 13, 2020. A pallet has a deck, a skid and a plurality of blocks, spacing the skid from the deck. The blocks comprise spacer portions and sleeve portions, wherein the sleeve portions may extend above and below the spacer portions. The deck and skid peripheral edges are cut away such that the deck and skid can be recessed with the blocks. The pallet constructed in this way can be made in any conventional size to meet the relevant norm or standard, while benefitting from the fact that the sleeve portions protect the edges of the deck or skid from impact. Furthermore, any impact imparted on the blocks is transmitted by the respective sleeve to the deck or skid. The elements of the pallet are connected without mechanical fasteners and the pallet can be easily repaired by removal and replacement of individual elements. A logistic system is also described.

U.S. patent application Ser. No. 16/964,613 entitled "Pallet with Integrated Weighing Function" (Ekkel) discloses a pallet, or like platform, for supporting a load to be lifted or lowered, comprising: a deck having a deck upper surface for placing the load thereon, a load sensor device, comprising a weighing element included in a measuring circuit, wherein the weighing element contacts the deck over a contact area such that the weighing element deforms in unity with the deck and an electrical property of the weighing element varies with the deformation of the weighing element.

U.S. patent application Ser. No. 16/093,150 entitled "Pallet" (de Bokx and Ekkel) was filed on Apr. 14, 2020. The elements of the pallet, namely the deck, the skid and the blocks are individually connected to each other by means of an adhesive. The adhesive may be of the type that remains elastic even after curing or setting and that can be subsequently cut with a wire or a knife to separate the elements or otherwise remove and replace a damaged element. The deck, the blocks and the skid are joined to each other without mechanical fasteners, in particular, without the use of nails, staples, screws or bolts. The elements of the pallet may be coated with a resin coating. The interaction between the coating and the adhesive may ensure a beneficial effect whereby the elements can be securely bonded together but the adhesive bond may be broken or cut without damage to the coating. The relative tensile strengths of these compositions are such that the cured resin has a tensile strength T(resin), the adhesive has a tensile strength T(adhesive), whereby T(resin)>T(adhesive).

U.S. patent application Ser. No. 09/399,391 (Phillips; et. al.) discloses a novel pallet comprising conventional pallet coated with an elastomeric material, such as a polyurea. The invention is further directed to a novel composite pallet comprising an elastomeric material, such as a polyurea, and one or more filler materials.

Wooden pallets continue to dominate the industry despite all their deficiencies. While metal pallets are strong, they are heavy and expensive. Sturdy plastic pallets have a long life but are more expensive than wood and more probe to theft and loss. Corrugated pallets are lighter than wood, but most cannot rack and don't stand up to the rigors of shipping or warehouse handling.

There is a need for a pallet which is light, cheap, and does not present a fire hazard. Storage of pallets after unloading increases the risk of a significant fire. While flame retardant materials are known, there are only a small number of examples of them being successfully incorporated into pallet construction materials.

What is needed is a pallet for storing and transporting goods that is resistant to damage and has a long-life expectancy.

Therefore, there is a long felt need in the art for the ability to better track products, and the various components contained therein, from point of origin to retail and beyond.

Also, there exists a need for storage containers equipped with tracking equipment to identify and update the status of the contents within the storage container, the information from which can be accessed through mobile devices and computers.

It is the primary object of the present invention to provide a long-life pallet with outstanding physical attributes that is relatively inexpensive to make and maintain and can be manufactured with relative ease. In addition, it is desirable to provide a low-cost pallet that meets and exceeds stringent strength standards.

SUMMARY OF THE INVENTION

The pallets of the present invention address these needs.

The pallet assembly of the present invention comprises a top plate, a load-force plate, a runner, and a plurality of load blocks disposed between the load force plate and the runner.

The load-force plate is disposed between the top plate and the runner and increases the load-bearing capacity of the top plate while adding strength to the pallet assembly.

The pallet assembly of the present invention includes a coating material that will protect shipment of foodstuffs and other products requiring sanitary conditions. The biocidal coating material prevents the growth of mold, fungi, bacteria, and viruses. The flame retardant additives will mitigate the fire hazard caused by the storage of large quantities of wood pallets.

The pallet assembly includes a pallet integrated module positioned between the load-force plate and the runner. The pallet integrated module collects journey data on location, temperature, humidity and shock along with store forward capability for those times in a pallet journey where the integrated module lacks a direct communication path to the cloud.

The load-force plate has either an X-form configuration or a cross-form configuration. In one preferred embodiment, an antenna is embedded in the cross-form configuration.

The present invention relates to a load bearing structure with a thinner core, substantially the same or lower overall weight while having improvement in supporting cargo. The load bearing structure has a top plate, a load-force transfer plate designed in either a window frame pattern or an X-shaped pattern, the support legs, and a bottom plate with a width having a thickness therebetween joining the top plate and the bottom plate.

The openings in the bottom plate and the load-force plate assist in reducing the weight of the pallet assembly. The load-force plate and the top plate can vary in thickness and wood type depending on the requirements of the customer. This enables a mitigation in supply chain fluctuations while managing costs.

The pallet assembly of the present invention is preferably constructed entirely of Baltic Birch.

The pallet is then coated in a spray or a dip coating. The coating is preferably either a spray coating, powder coating or a fluid bed coating to protect the wood and to add strength to the pallet.

The pallet assembly of the present invention is designed to be able to quickly adjust its weight, load carrying capability, strength, and longevity to meet the needs of our customers and the needs of our business model. The business model is to lease pallets to our customers, and through the pallet design, ensure that they are constructed to make many cycles from source to final customer with minimal damage. The pallet is also designed to be quickly cleaned, refurbished, and recycled into service. The pallet also has a biocide coating, a flame-retardant additive, integrated into and delivered by the polyurea coating, to hinder the growth of mold, fungus, bacteria, and viruses. A unique feature is that the pallet records environmental data and communicates its location and other data to other pallets and to interested parties.

For a complete understanding of the pallets, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only and are not intended as a definition of the limits of the invention.

DETAILED DESCRIPTION OF THE PREFERRED EMBODIMENTS

Figure 1:
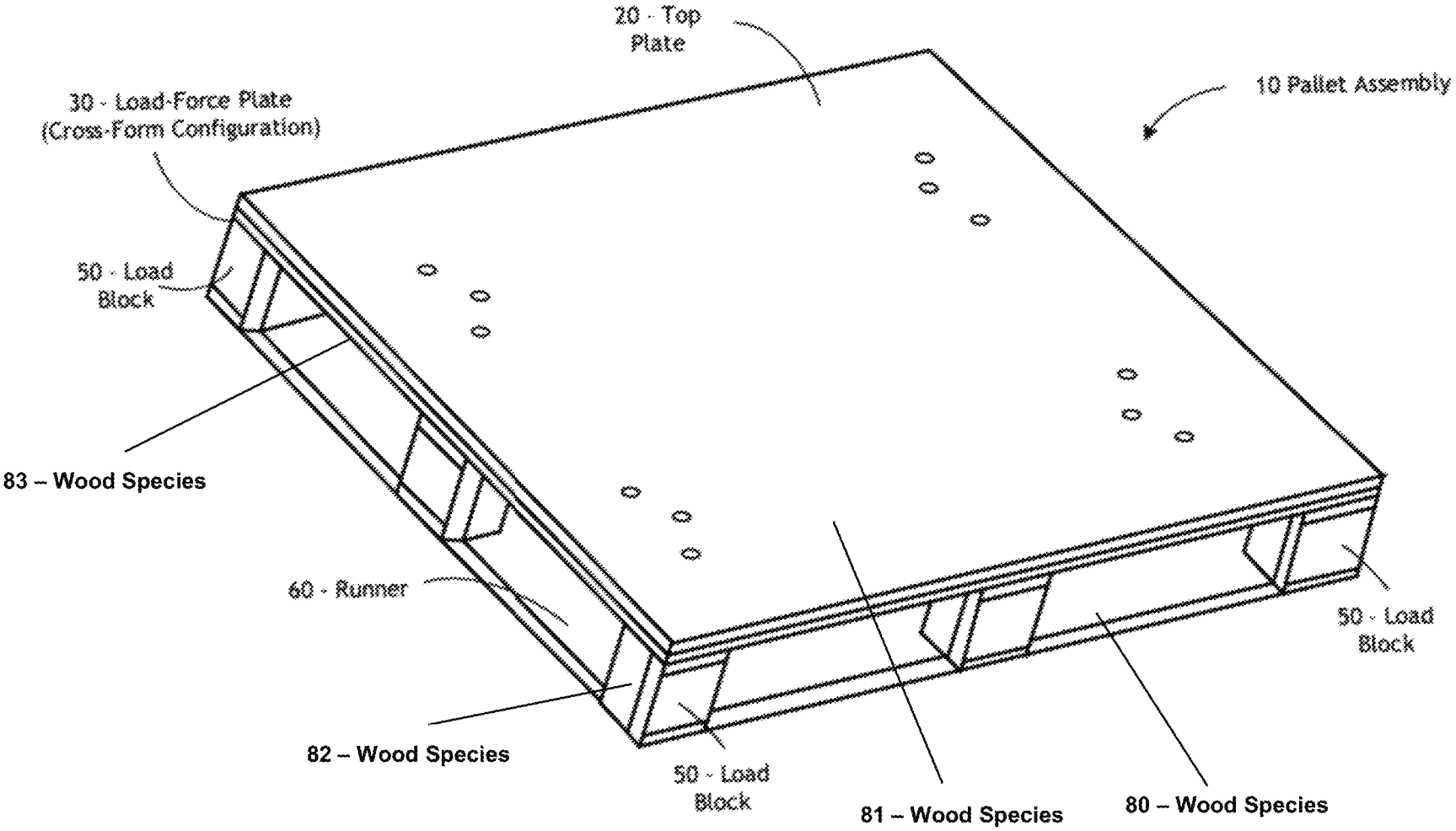
FIG. 1 depicts an assembly view of the first preferred embodiment of the pallet assembly of the present invention.
Figure 2A:
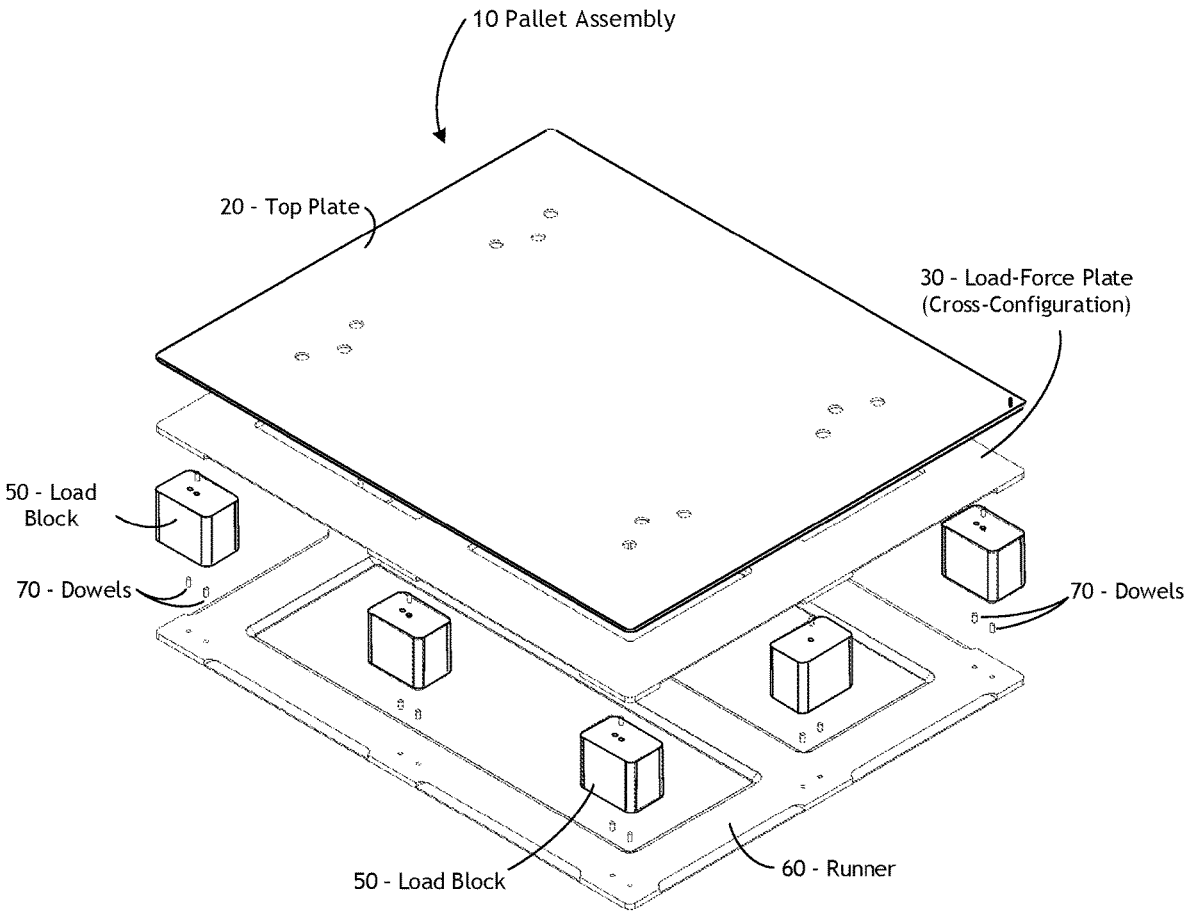
FIG. 2A depicts a layered top view depicting a top plate, a load-force plate, and a plurality of load blocks with aligning dowels symmetrically and equally positioned upon a runner of the first preferred embodiment of the pallet assembly of FIG. 1.
Figure 2B:
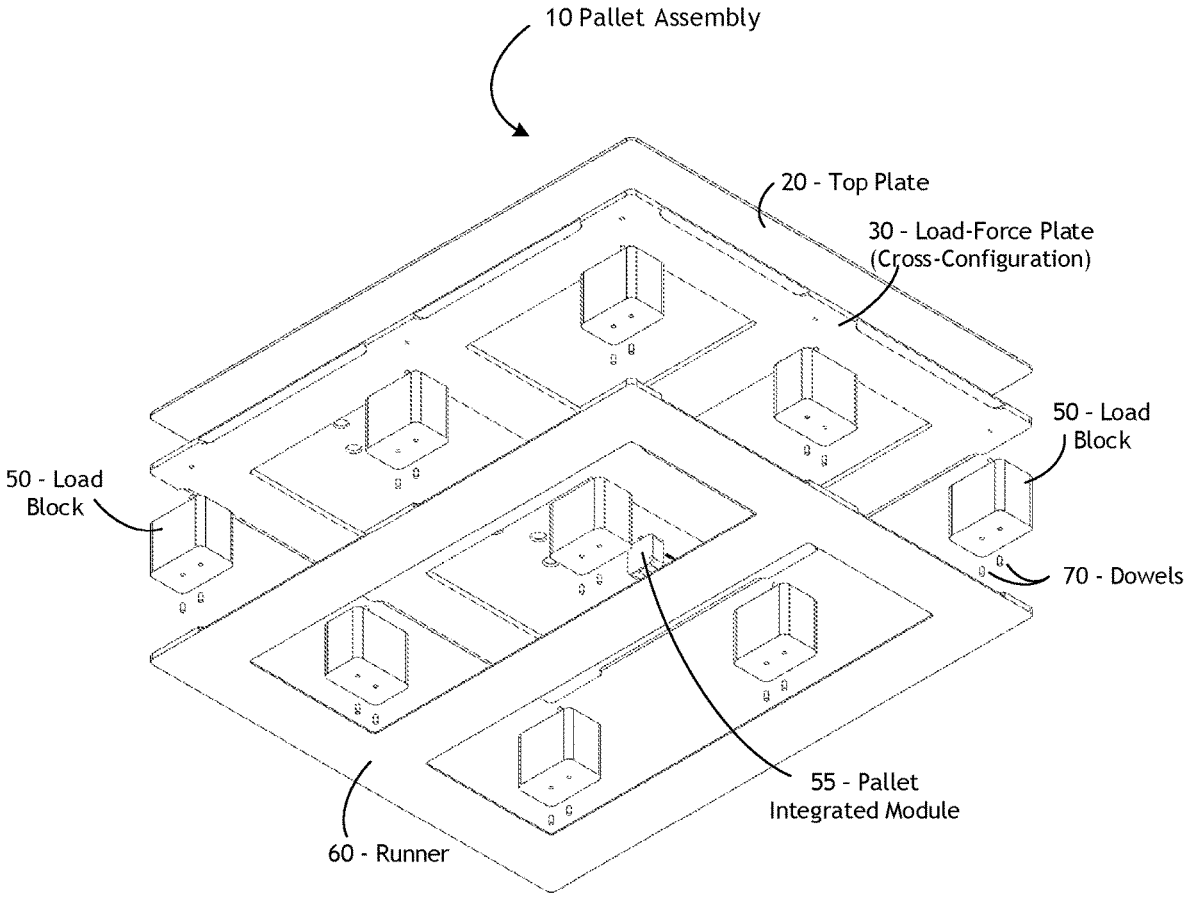
FIG. 2B depicts a layered bottom view depicting the top plate, the load-force plate, the pallet integrated module, the nine (9) load blocks with aligning dowels symmetrically and equally positioned on the runner, and the pallet integrated module abutting the center load block of the first preferred embodiment of the pallet assembly of FIG. 2A.

Referring now to the drawings, FIGS. 1, 2A, and 2B depict the first preferred embodiment of the pallet assembly

[10] of the present invention. The pallet assembly of the present invention [10] comprises a top plate [20], a load-force plate [30], a runner [60], a pallet integrated module [55], and a plurality of load blocks [50] disposed between the load force plate [30] and the runner [60].

FIG. 2A depicts a layered top view depicting the top plate [20], the load-force plate [30], and a plurality of load blocks [50] with aligning dowels [70] symmetrically and equally positioned on the runner [60] of the first preferred embodiment of the pallet assembly [10] of FIG. 1.

The outer surface of the pallet assembly of the present invention [10], the top plate [20], the load-force plate [30], and the runner [60] preferably have generally, square shapes. The load blocks [50] are symmetrically distributed about the pallet assembly [10] between the load-force plate [30] and the runner [60] such that a forklift (not shown) can approach the pallet assembly [10] from any of the four side surfaces thereof.

FIG. 2B depicts a layered bottom view of the top plate [20], the load-force plate (cross form) [30], the pallet integrated module [55], the nine (9) load blocks [50] with aligning dowels [20] symmetrically and equally positioned on the runner. The pallet integrated module [55] abuts the center load block of the nine load blocks [50] of the first preferred embodiment of the pallet assembly [10] of FIG. 2A. The pallet integrated module [55] is preferably battery powered. The battery unit for the pallet integrated module lasts for the entire life of the unit. The pallet integrated module [55] also has antennas, microprocessors, and memory capability. The pallet integrated module [55] monitors temperature, mechanical shock, humidity, and time. The pallet integrated module [55] has a unique electronic identity programmed at the factory when the pallet is assembled. The pallet integrated module [55] also can be programmed at the customer's location, to identify the material that is on the pallet. This customer programming will be changed each time the pallet assembly of the present invention [10 and 110] makes a cycle from the loading location to the unloading location and back to the customer's loading location. The packaging of the pallet integrated module [55] is robust enough to survive contact with pallet jacks and forklifts.

Figure 3A:
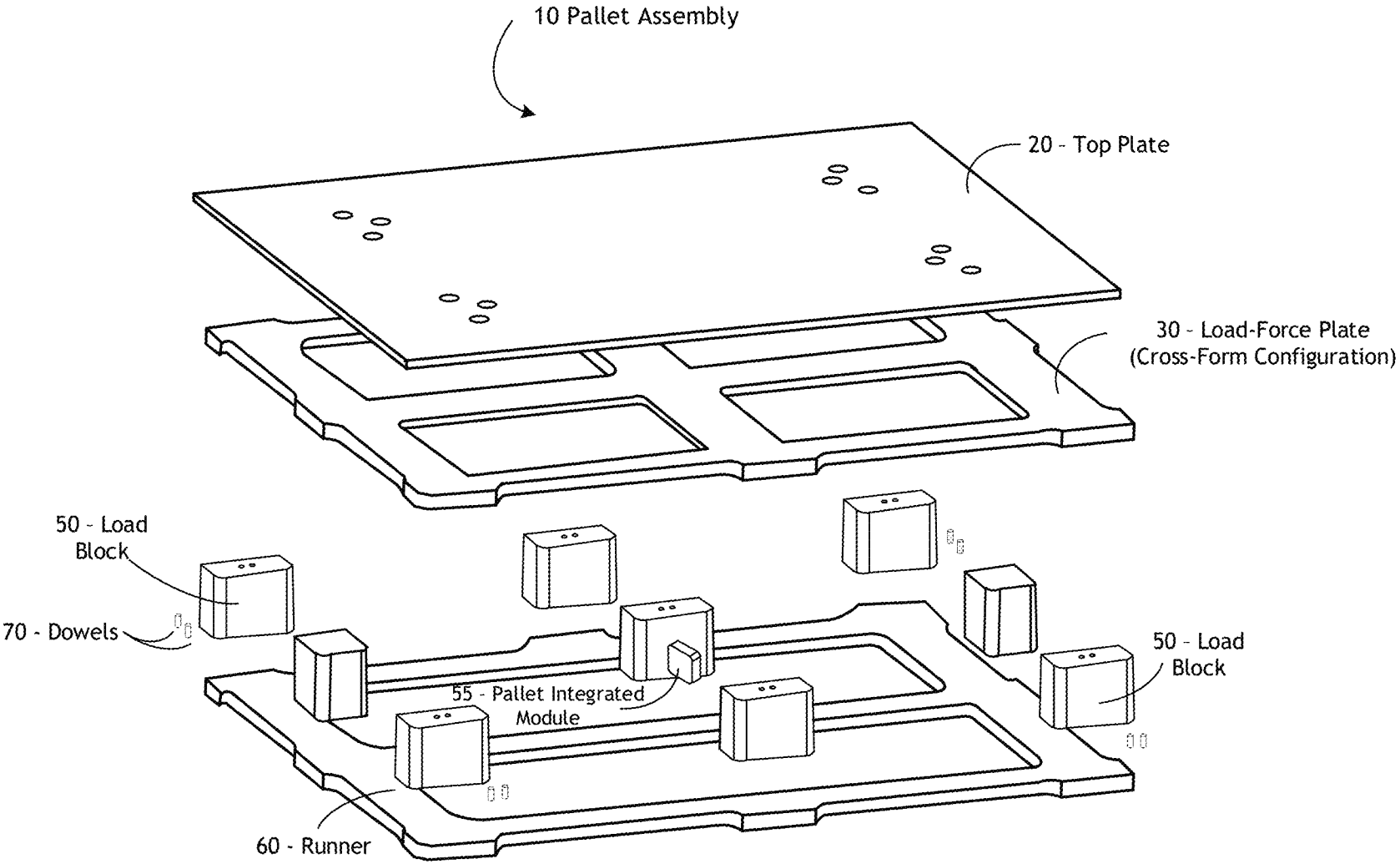
FIG. 3A depicts a layered top view depicting the top plate, the load-force plate (cross-form) with aligning dowels, the pallet integrated module, the nine (9) load blocks symmetrically and equally positioned on the runner and the pallet integrated module abutting the center load block of the first preferred embodiment of the pallet assembly of FIG. 2A.

FIG. 3A depicts a layered top view depicting the top plate [20], the load-force plate (cross-form) [30], the pallet integrated module [55], the nine (9) load blocks [50] symmetrically and equally positioned on the runner [60] of the first preferred embodiment of the pallet assembly [10] of the present invention.

Figure 3B:
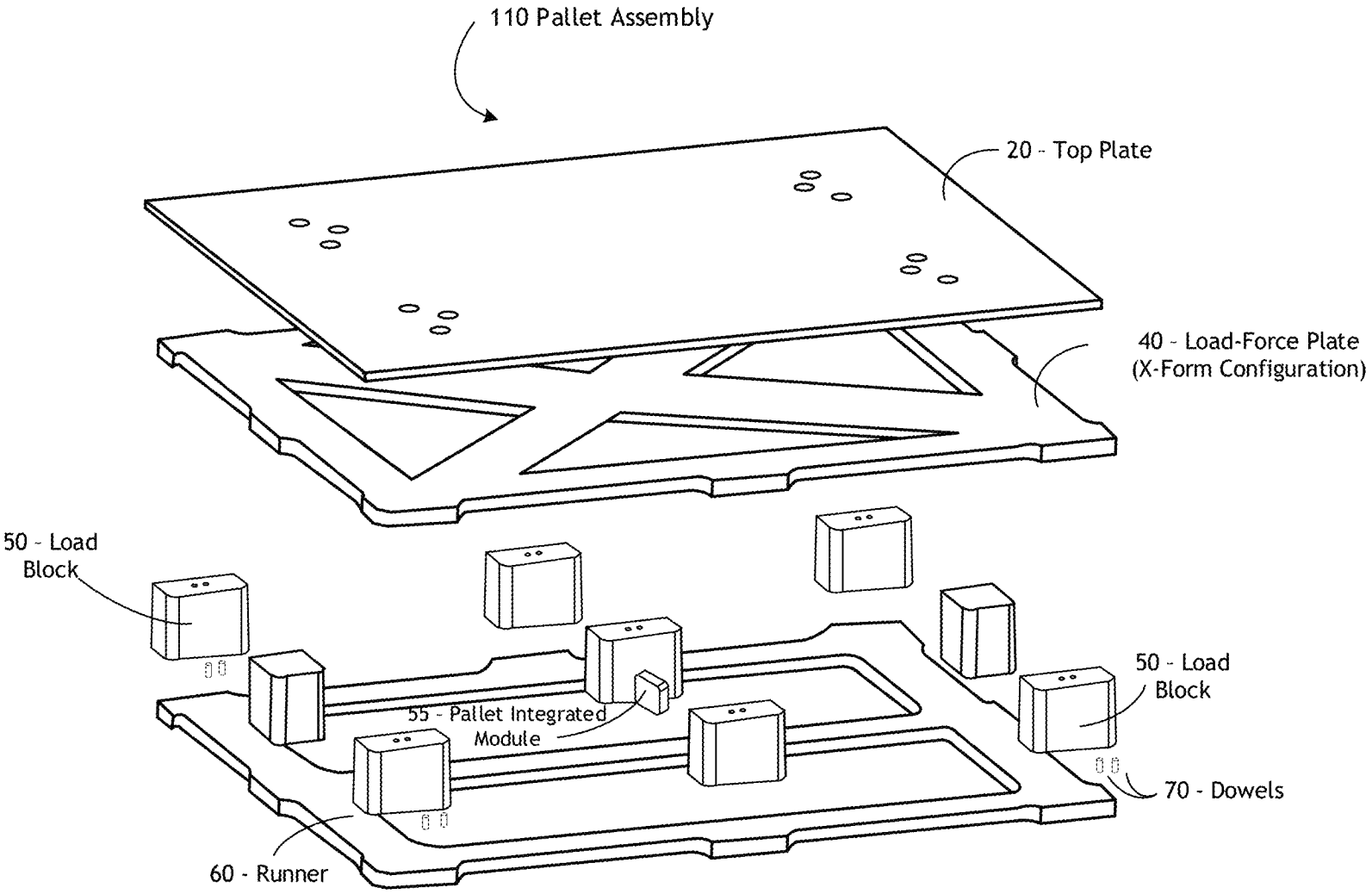
FIG. 3B depicts a layered top view depicting the top plate, the load-force plate (X-form), the pallet integrated module, the nine (9) load blocks with aligning dowels symmetrically and equally positioned on the runner and the pallet integrated module abutting the center load block of a second preferred embodiment of the pallet assembly of the present invention.

FIG. 3B depicts a layered top view depicting the top plate [20], the load-force plate (X-form) [40], the pallet integrated module [55], the nine (9) load blocks [50] symmetrically and equally positioned on the runner [60] of the second preferred embodiment of the pallet assembly [110] of the present invention.

Figure 4:
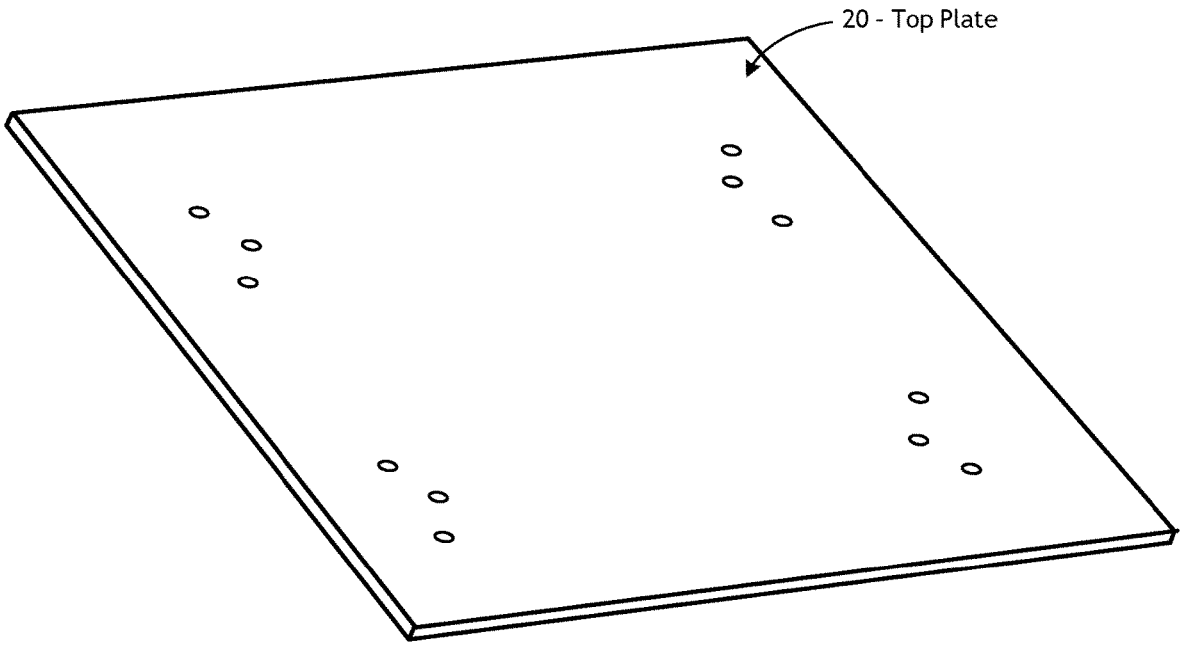
FIG. 4 depicts an assembly view of the top plate of the pallet assembly of the present invention.

FIG. 4 depicts an assembly view of the top plate [20] of the pallet assembly [10, and 110] of the present invention.

Figure 5:
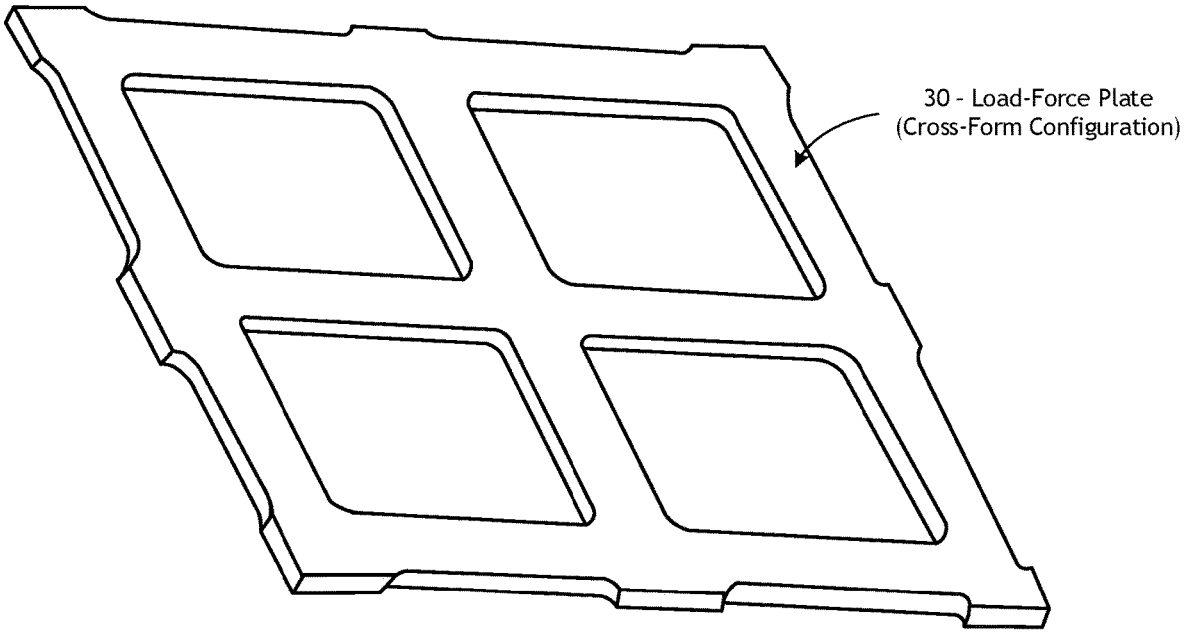
FIG. 5 depicts an assembly view of the load-force plate having a cross-form configuration for the first preferred embodiment of the pallet assembly of the present invention.

FIG. 5 depicts an assembly view of the load-force plate [30] having a cross-form configuration for the first and second preferred embodiments of the pallet assembly [10 and 110] of the present invention.

Figure 6:
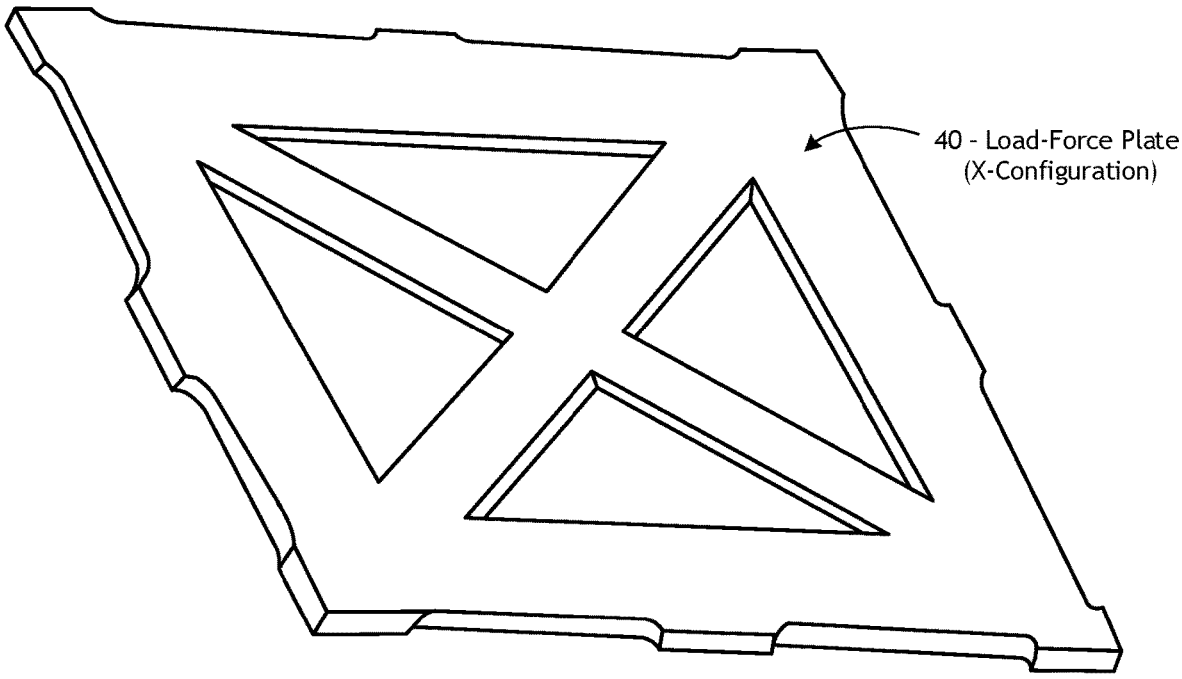
FIG. 6 depicts an assembly view of the load-force plate having an X-form configuration for the second preferred embodiment of the pallet assembly of the present invention.

FIG. 6 depicts an assembly view of the load-force plate [40] having an X-form configuration for the second preferred embodiment of the pallet assembly [110] of the present invention.

Figure 7:
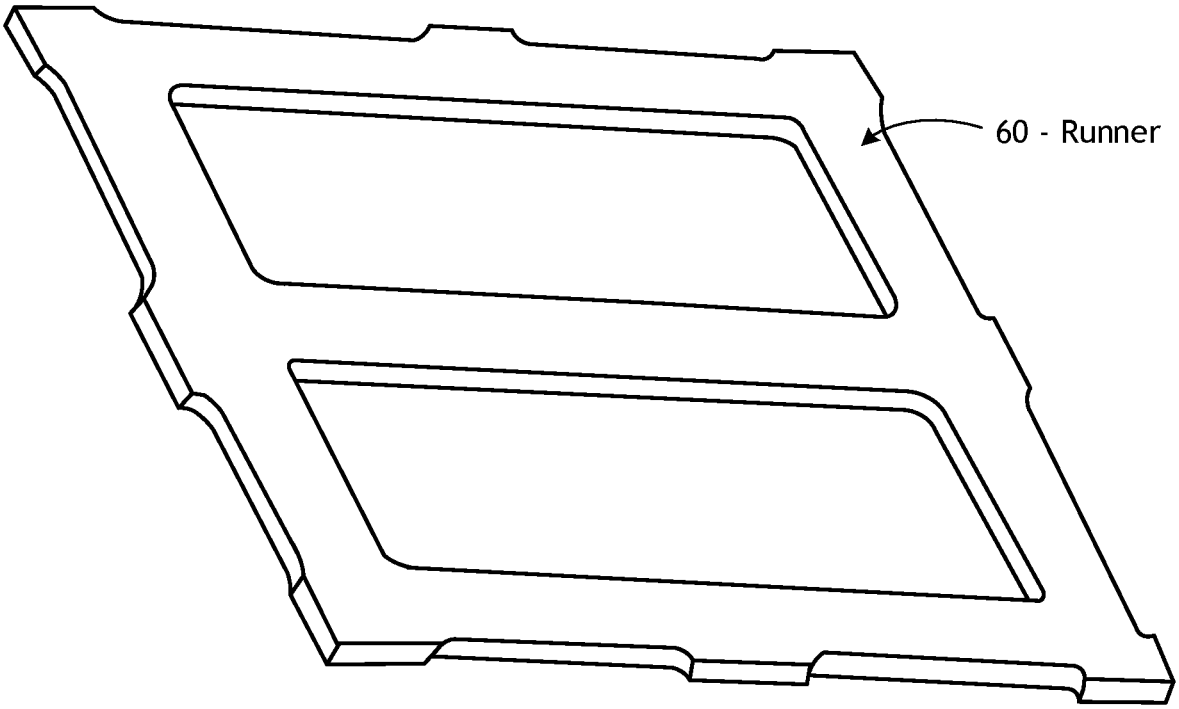
FIG. 7 depicts an assembly view of the runner for the first, and second preferred embodiments of the pallet assembly of the present invention.

FIG. 7 depicts an assembly view of the runner [60] for the first and second preferred embodiments of the pallet assembly [10 and 110] of the present invention.

Figure 8A:
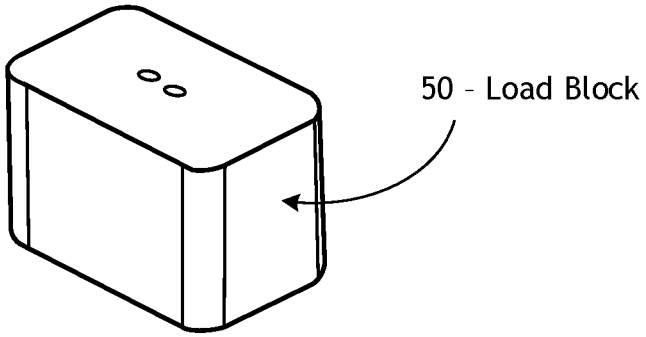
FIG. 8A depicts an exploded detail view of a load block for use in the first, and second preferred embodiments of the pallet assembly of the present invention.

FIG. 8A depicts an exploded detail view of a load block [50] for use in the first and second preferred embodiments of the pallet assembly [10 and 110] of the present invention.

Figure 8B:
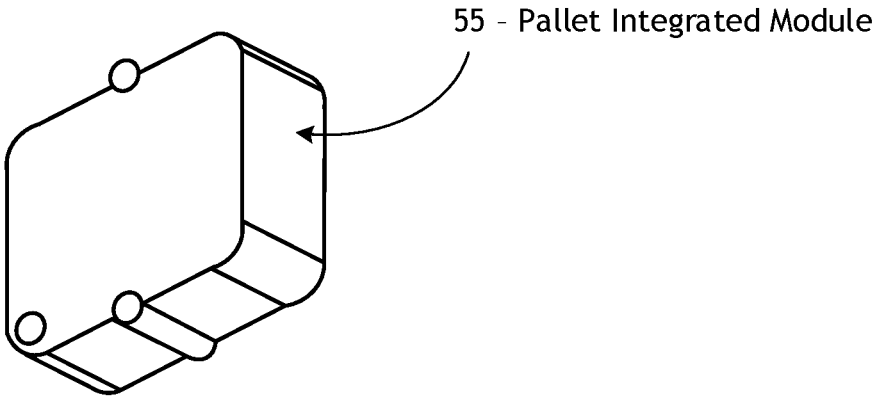
FIG. 8B depicts an exploded detail view of the pallet integrated module for the first and second preferred embodiments of the pallet assembly of the present invention.

FIG. 8B depicts an exploded detail view of the pallet integrated module [55] for in the first and second preferred embodiments of the pallet assembly [10 and 110] of the present invention.

Figure 9A:
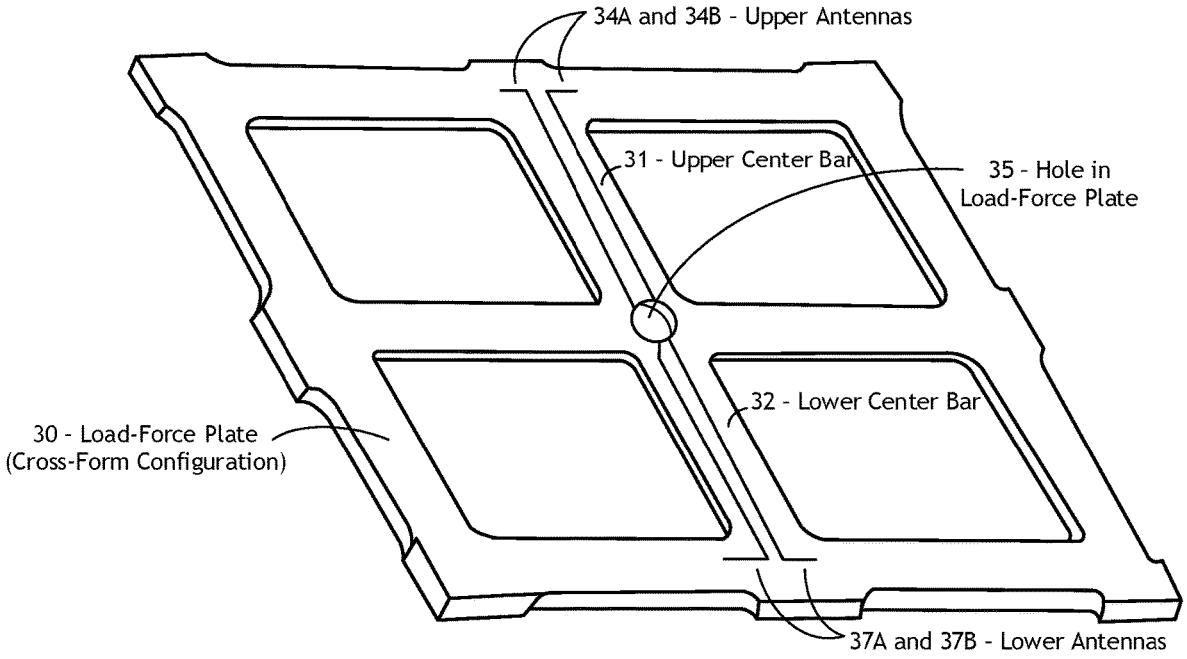
FIG. 9A depicts a detailed view of the first preferred embodiment of the pallet assembly of the present invention with antennas mounted in the load force plate (cross form) serving as a signal extender.

FIG. 9A depicts a detailed view of the first preferred embodiment of the pallet assembly of the present invention with antennas mounted in the load force plate (cross form) [30] serving as a signal extender on the load-force plate (cross form) [30] of the first and second preferred embodiments of the pallet assembly [110] of the present invention. The upper antennas [34A and 34B] run parallel to each other and are embedded in the upper center bar [31] of the cross of the load force plate (cross form) [30] and the lower antennas [37A and 37B] run parallel to each and are embedded in the lower center bar [32] of the cross of the load force plate (cross form) [30].

The load force plate depicted in FIG. 1A is the cross-form load force plate [30]. However, it is understood that one skilled in the art can readily apply the principles of the signal extender of FIG. 9A to the load-force plate (X-form configuration) [40].

Figure 9B:
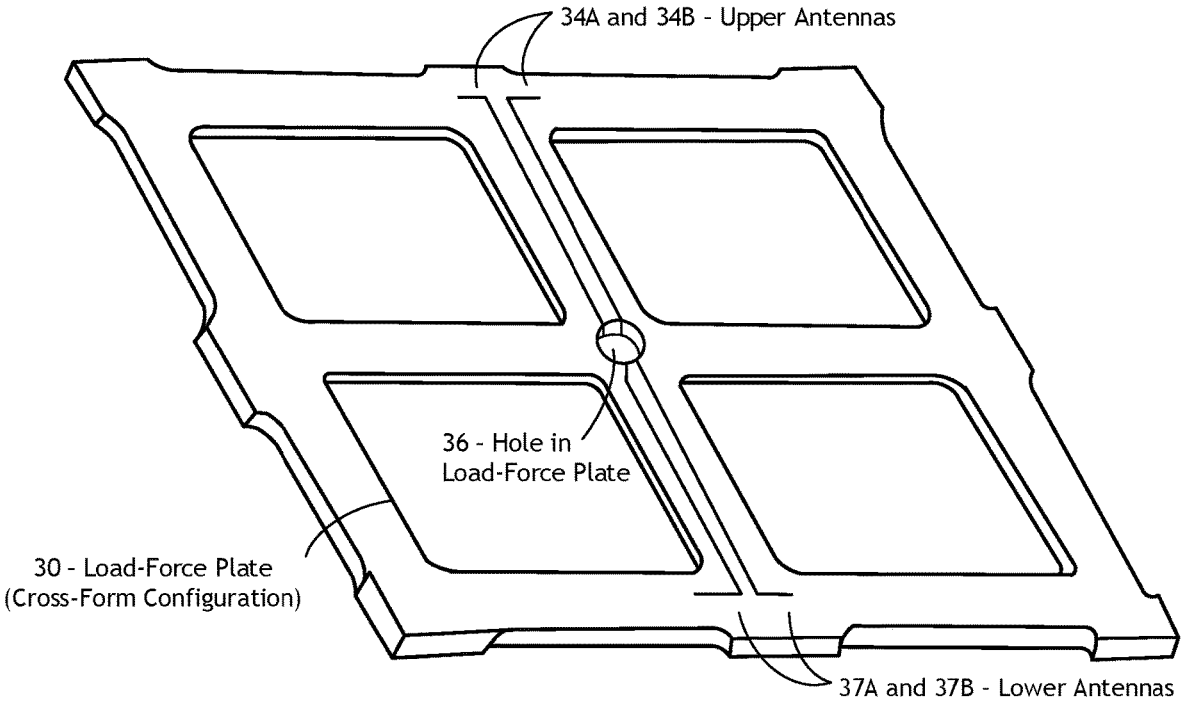
FIG. 9B depicts a detailed view of the first preferred embodiment of the pallet assembly of the present invention with antennas mounted in the load force plate (cross form) serving as an antenna contact tracking sensor.

FIG. 9B depicts a detailed view of the first preferred embodiment of the pallet assembly of the present invention with antennas mounted in the load force plate (cross form) [30] serving as an antenna contact tracking sensor on the load-force plate (cross form) [30] of the first and second preferred embodiments of the pallet assembly [10 and 110] of the present invention. The upper antennas [34A and 34B] run parallel to each other and are embedded in the upper center bar [31] of the cross of the load force plate (cross form) [30] and the lower antennas [37A and 37B] run parallel to each other and are embedded in the lower center bar [32] of the cross of the load force plate (cross form) [30]. The antennas [34A and 34B] and [37A and 37B] formed in the load force plate (cross form) [30] drop down into a hole formed at the juncture of the cross to contact the tracking sensor, which is the pallet integrated module [55].

The load force plate depicted in FIG. 9B is the cross-form load force plate [30]. However, it is understood that one skilled in the art can readily apply the principles of the signal extender of FIG. 9B to the load-force plate (X-form configuration) [40].

Figure 9C:
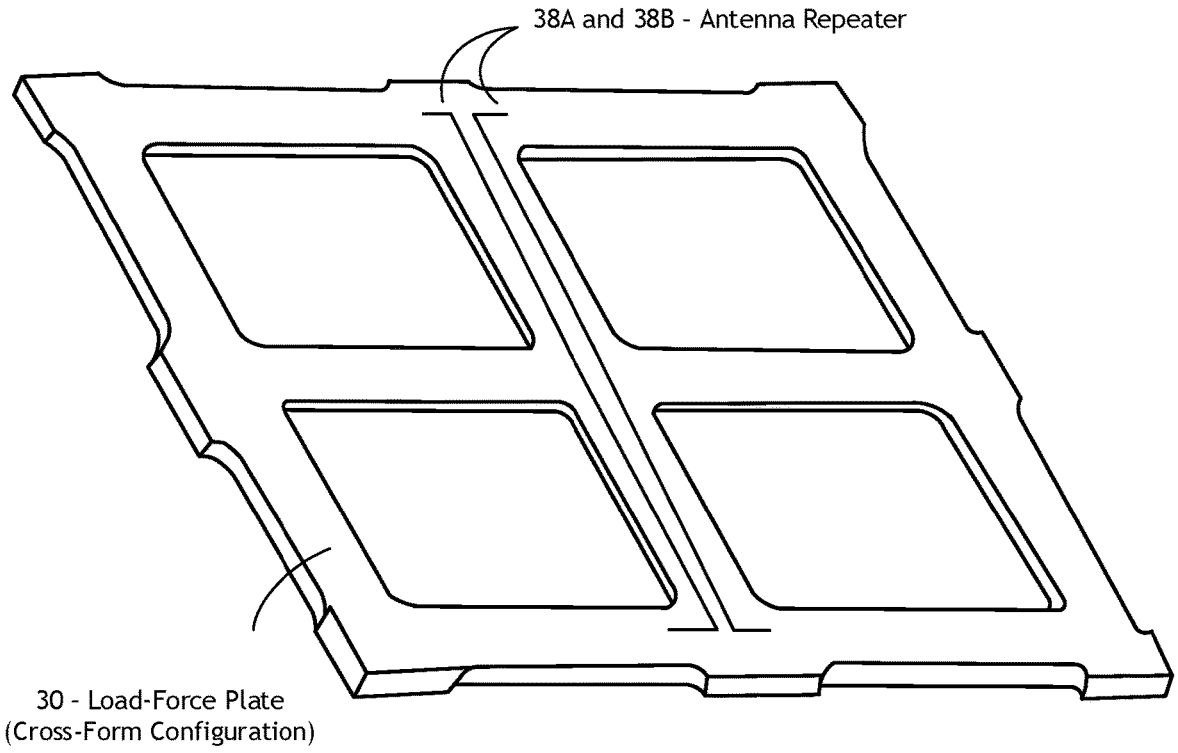
FIG. 9C depicts a detailed view of the first preferred embodiment of the pallet assembly of the present invention with antennas mounted in the load force plate (cross form) serving as an antenna repeater where there is no electrical contact to the pallet integrated module.

FIG. 9C depicts a detailed view of the first preferred embodiment of the pallet assembly of the present invention [10] with antennas mounted in the load force plate (cross form) [30] serving as an antenna repeater where there is no electrical contact to the tracking sensor (pallet integrated module [55]).

The antenna repeaters [38A and 38B] are embedded in and run parallel to each other in the center bar of the cross of the load force plate (cross form) [30] and make no electrical contact with the pallet integrated module (tracking sensor) [55].

The load force plate depicted in FIG. 9C is the cross-form load force plate [30]. However, it is understood that one skilled in the art can readily apply the principles of the signal extender of FIG. 9C to the load-force plate (X-form configuration) [40].

Figure 10A:
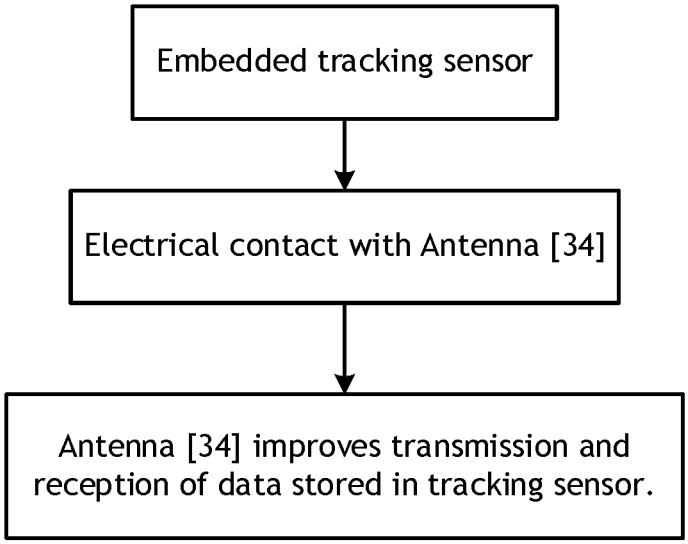
FIG. 10A depicts a flow chart for the antenna that is electrically connected to the pallet integrated module of FIG. 8B.

FIG. 10A depicts a flow chart for the antenna that is electrically connected to the pallet integrated module of FIGS. 9A and 9B.

Figure 10B:
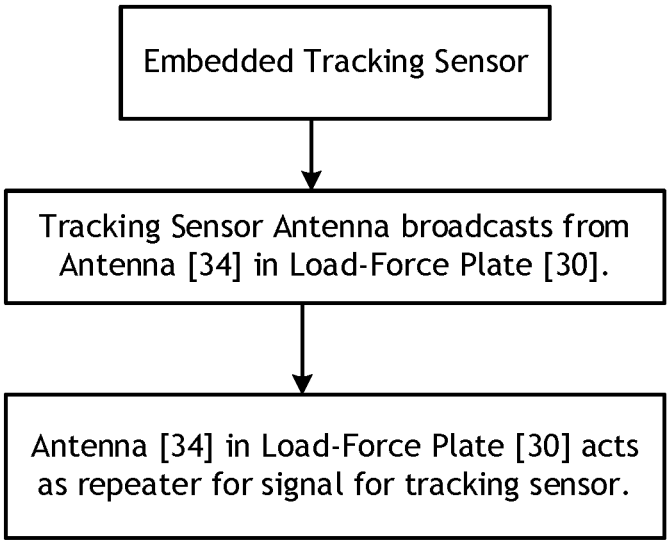
FIG. 10B depicts a flow chart depicting the functioning of the antenna repeater that is printed onto or embedded into the load-force plate that acts like a signal repeater and is not directly connected to the pallet integrated module.

FIG. 10B depicts a flow chart depicting the functioning of the antenna repeater that is printed onto or embedded into the load-force plate, that acts like a signal repeater, and is not directly connected to the pallet integrated module.

The coating is smooth, which enables a more thorough cleaning. There is no place for dirt, bacteria, mold, fungus, microbes, or viruses to hide.

Another advantage of the pallet assembly [10 and 110] of the present invention is that the species of wood selected for the pallet assembly [10 and 110] varies and is dependent upon the cargo being transported. Different species of wood [80, 81, 82, 83] are selected for the top plate [20], the load-force plate [30 or 40], the plurality of load blocks [50], and the runner [60] depending upon the weight of the cargo, respectively. By changing the species of wood, the strength and weight of the pallet assembly can be configured to meet the requirements of the customer. If the customer is shipping steel or cast parts, the strength of the pallet components must be reconfigured to accommodate the weight of these parts. In this example, the pallet components, a dense wood such as Baltic Birch or oak is used. If the customer is shipping a light load, such as a child's game or toy, a less dense wood, such as pine is selected. As the wood species are changed, the pallet cost and weight can be reconfigured to meet the requirements of the shipping industry while also meeting the needs of the customer for weight reduction and cost. All our additives are of such a small micron size, they don't cause the polyurea to be off from ratio. Off ratio polyurea will not cure properly and will not have all the properties of a properly cured polyurea.

Dowels, preferably wooden, are used to accurately locate the top plate, the legs, and the bottom plate within very tight tolerances. The pallet of the present invention can be readily assembled with the wooden dowels that facilitate attachment of transverse deck boards to parallel stringers in a quick and efficient manner. Also, the dowels provide structural stability during the adhesive curing and prevent rotation of the blocks during assembly. This build technique enables tight tolerances between all the components. For this equipment to properly pick and lift the pallet, the pallet must be built to tight tolerances.

The pallet integrated module [55] collects journey data on location, temperature, humidity, and shock along with "store forward" capability during unconnected times of the journey. All this data is sent to the cloud for parsing, future queries, report generation and alert capability. The module is capable of "over the air" software upgrades and has various modes of connectivity not only to mitigate connectivity costs but to seamlessly interact with the complete ecosystem.

The pallet integrated module [55] is programmed and then the pallet assembly of the present invention is sent to the customer who is renting or leasing the pallet. Information about the contents of the pallet is programmed into the electronics at the location of the customer. During shipping, the electronics monitors, temperature, G force, humidity, and other elements versus time. This data can be accessed at various places along the shipping route. The data collected helps ensure that contents of the pallet assembly of the present invention are not exposed to inappropriate temperatures or other harmful environmental conditions. The data also helps to prove that the pallet contents were properly cared for during shipping. The top plate [20], the load-force plate [30 and 40], the load blocks [50], and the runner [60] are preferably joined with an adhesive.

Suitable polymeric materials include, but are not limited to, polyolefins, polyesters, polyurethanes, polyureas, epoxies, polyurea-polyurethane hybrids, and combinations thereof. Desirably, the polymeric material comprises polyurea, polyurethane, or a combination thereof (see for example U.S. patent application Ser. No. 09/399,271 entitled "Novel Pallets" (Phillips; et al.).

The pallet assemblies [10, and 110] of the present invention are comprised of a conventional pallet coated with a fast-curing elastomeric material using spray techniques whereby a homogeneous, non-porous, and monolithic coating is formed. The desired elastomeric materials used are prepared by initiating the reaction of an aliphatic or aromatic isocyanate-terminated compound or polymer with an aliphatic or aromatic amine-terminated compound or polymer immediately before applying the elastomeric material to the surface to be coated. Desirably, the reactive components (i.e., isocyanate-containing and amine-containing materials) are mixed directly in a spray gun used to apply the elastomeric material. The thickness of the elastomeric coating can easily be controlled by conventional application means. It is important that the thickness of the elastomeric coating be enough so that the coating is resistant to impact that is normal in use. The desired thickness of the elastomeric coating on the pallet material is between approximately 1 mm and 250 mm, with the most desired thickness of between 60 mm and 75 mm.

The pallet assemblies of the present invention comprise one or more polymeric materials optionally in combination with one or more filler materials. Suitable polymeric materials include any polymeric material capable of being formed into a polymeric board or sheet. Suitable polymeric materials include, but are not limited to, polyolefins, polyesters, polyurethanes, polyurea, epoxies, polyurea-polyurethane hybrids, and combinations thereof. Desirably, the polymeric material comprises polyurea, polyurethane, or a combination thereof. More desirably, the polymeric material comprises a polyurethane foam. The filler material may be organic or inorganic filler material in the form of particulate material, fibers, fabrics, rods, or any other structural reinforcement. Suitable inorganic filler materials include, but are not limited to, calcium carbonates, clays, silica, sand, glass fibers and carbon fibers. Suitable organic fillers include, but are not limited to, fibers such as cotton, rayon, nylon, and other polymeric fibers, such as polyolefin fibers and aramid fibers.

The deflection, stress, strain testing of the load-force plate (cross-form) best compared to X-FORM load force plate (X-form) and the standard pallet. ISO 8611 Rack Test Simulation (2750 lb.) were conducted, and the results are shown below:

Deflection Testing:

The standard pallet performed well. The deflection was 100 mm before the 2750 lb. load was applied. The deflection was 87.39 mm after the 2750 lb. load was applied.

The load-force plate (X-form) performed better. The deflection was 100 mm before the 2750 lb. load was applied. The deflection was 93.98 mm after the 2750 lb. load was applied.

The load-force plate (cross-form) performed best. The deflection was 100 mm before the 2750 lb. load was applied. The deflection was 94.35 mm after the 2750 lb. load was applied.

Stress Testing:

The standard pallet performed well. The stress was 8.522e^+7 after the 2750 lb. load was applied.

The load-force plate (X-form) performed better. The stress was 6.114e^+7 after the 2750 lb. load was applied.

The load-force plate (cross-form) performed best. The stress was 5.822e^+7 after the 2750 lb. load was applied.

Strain Testing:

The standard pallet performed well. The stress was 5.648e^−03 after the 2750 lb. load was applied.

The load-force plate (X-form) performed better. The stress was 3.943e^−03 after the 2750 lb. load was applied.

The load-force plate (cross-form) performed best. The stress was 3.688e^−03 after the 2750 lb. load was applied.

The pallet assembly of the present invention is designed to meet the requirements of the customers, as well as international standards for strength, flex, flame, and smoke requirements. The thin top plate, the load-transfer plate, the support blocks, and the runner will all be coated in a spray or a dip coating (powder coating or fluid bed coating) to protect the wood and to add strength to the pallet assembly of the present invention.

Throughout this Application, various Patents and Applications are referenced by number and inventor. The disclosures of these documents in their entireties are hereby incorporated by reference into this specification in order to more fully describe the state of the art to which this invention pertains.

It is evident that many alternatives, modifications, and variations of the pallets of the present invention will be apparent to those skilled in the art in lieu of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

10. Pallet Assembly (1$^{st}$ preferred embodiment)
20. Top Plate
30. Load-Force Plate (Cross-Form configuration)
31—Upper Center Bar
32—Lower Center Bar
34A and 34B. Upper Antennas
36. Hole in Load-Force Plate
37A and 37B. Upper Antennas
38A and 38B. Antenna Repeater
40. Load-Force Plate (X-Form configuration)
50. Load Block
55. Pallet Integrated Module
60. Runner
70. Dowel
110. Pallet Assembly (2$^{nd}$ preferred embodiment)

The invention claimed is:

1. A pallet assembly comprising:
a top plate and a runner having four side surfaces;
a pallet integrated module mounted to the pallet assembly and configured to collect journey data for transmission to a cloud;
a load-force plate disposed between the top plate and the runner, the load-force plate being configured to increase load bearing capacity of the top plate while adding strength to the pallet assembly, an antenna for the pallet integrated module being integrated with the load-force plate; and
a plurality of load blocks disposed between the load-force plate and the runner, the plurality of load blocks being symmetrically positioned such that a forklift can enter from any of the four side surfaces of the runner, the runner being disposed under the plurality of load blocks,
wherein the pallet assembly includes a coating material that protects shipment of foodstuffs and other products that require sanitary conditions.

2. The pallet assembly of claim 1, further comprising dowels configured to locate the top plate, the plurality of load blocks, and the runner with respect to one another.

3. The pallet assembly of claim 1, wherein the coating material includes a polyolefin, a polyester, a polyurethane, a polyurea, an epoxy, a polyurea-polyurethane hybrid, or a combination thereof.

4. The pallet assembly of claim 1, wherein the coating material is configured to prevent mold, virus, bacteria, and fungus growth.

5. The pallet assembly of claim 1, wherein:
the top plate is made of a first wood species,
the runner is made of a second wood species,
the load-force plate is made of a third wood species,
the plurality of load blocks is made from load-block wood species, and
the first wood species, the second wood species, the third wood species, and the load-block wood species are selected based on cargo to be transported, shipping industry requirements, and a weight reduction target.

6. The pallet assembly of claim 1, wherein the load-force plate has a cross-form configuration or X-form configuration.

7. The pallet assembly of claim 6, wherein the load-force plate has the X-form configuration.

8. The pallet assembly of claim 7 wherein:
the load-force plate includes a first corner, a second corner, a third corner diagonally opposite the first corner, and a fourth corner diagonally opposite the second corner; and
the X-form configuration defines a first support spanning from the first corner to the third corner and a second support spanning from the second corner to the fourth corner.

9. The pallet assembly of claim 1, wherein the antenna is embedded in the load-force plate.

10. The pallet assembly of claim 1, wherein the antenna is printed onto the load-force plate.

11. The pallet assembly of claim 1, wherein the antenna extends along the load-force plate.

12. The pallet assembly of claim 11, wherein:
the load-force plate has a cross-form configuration that defines a first edge section, a second edge section, a third edge section, a fourth edge section, and a middle section;
the middle section connects to the first edge section at a midpoint of the first edge section;
the middle section connects to the second edge section at a midpoint of the second edge section;
the middle section connects to the third edge section at a midpoint of the third edge section;
the middle section connects to the fourth edge section at a midpoint of the fourth edge section; and
the antenna extends from the first edge section, through the middle section, to the third edge section.

13. The pallet assembly of claim 11, wherein:
the load-force plate has a cross-form configuration that defines a first edge section, a second edge section, a third edge section, a fourth edge section, and a middle section;
the middle section connects to the first edge section at a midpoint of the first edge section;
the middle section connects to the second edge section at a midpoint of the second edge section;

the middle section connects to the third edge section at a midpoint of the third edge section;

the middle section connects to the fourth edge section at a midpoint of the fourth edge section;

the antenna is located in the first edge section;

a second antenna is located in the third edge section; and the antenna and the second antenna electrically connect to the pallet integrated module via the middle section.

14. The pallet assembly of claim 13, wherein the load-force plate includes a hole in the middle section through which extend electrical connections from the pallet integrated module to the antenna and the second antenna.

15. The pallet assembly of claim 1, wherein the antenna is electrically distinct from the pallet integrated module and is configured to act as a signal repeater.

16. The pallet assembly of claim 1, wherein the antenna is electrically connected to the pallet integrated module.

17. The pallet assembly of claim 1, wherein the pallet integrated module is physically separated from the load-force plate.

18. The pallet assembly of claim 17, wherein the pallet integrated module is mounted to one of the plurality of load blocks.

19. The pallet assembly of claim 1, wherein the coating material includes a flame-retardant additive.

* * * * *